US010988151B2

(12) United States Patent
Hounschell et al.

(10) Patent No.: US 10,988,151 B2
(45) Date of Patent: Apr. 27, 2021

(54) SYSTEM AND METHOD FOR CONTROLLING A LEVEL CROSSING OF A RAILWAY TRACK

(71) Applicant: ALSTOM TRANSPORT TECHNOLOGIES, Saint-Ouen (FR)

(72) Inventors: John Hounschell, Melbourne, FL (US); Jeffrey Fries, Grain Valley, MO (US); James Frisbie, Melbourne, FL (US); Tony Spagnolia, Melbourne, FL (US); Brian Isaacson, Melbourne, FL (US)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 463 days.

(21) Appl. No.: 16/055,727

(22) Filed: Aug. 6, 2018

(65) Prior Publication Data

US 2020/0039550 A1 Feb. 6, 2020

(51) Int. Cl.

| | |
|---|---|
| ***B61L 29/24*** | (2006.01) |
| ***B61L 29/30*** | (2006.01) |
| ***B61L 29/22*** | (2006.01) |
| ***B61L 23/04*** | (2006.01) |

(52) U.S. Cl.

CPC ..... *B61L 29/246* (2013.01); *B61L 29/30* (2013.01); *B61L 23/041* (2013.01); *B61L 29/226* (2013.01)

(58) Field of Classification Search

CPC ..... B61L 29/246; B61L 29/30; B61L 29/226; B61L 23/041

See application file for complete search history.

(56) References Cited

U.S. PATENT DOCUMENTS

| | | | | |
|---|---|---|---|---|
| 2,310,716 A * | 2/1943 | Stephenson | B61L 29/226 49/334 |
| 3,601,603 A * | 8/1971 | Hughson | B61L 29/226 246/125 |
| 7,075,427 B1 * | 7/2006 | Pace | B61L 23/06 246/125 |
| 2005/0110482 A1 * | 5/2005 | Ballinger | B61L 23/041 324/207.25 |
| 2008/0019701 A1 * | 1/2008 | Tam | B61L 23/041 398/141 |
| 2012/0286103 A1 * | 11/2012 | Hilleary | B61L 23/041 246/125 |
| 2012/0314332 A1 * | 12/2012 | Fries | G01R 19/20 361/152 |

(Continued)

*Primary Examiner* — Jason C Smith

(74) *Attorney, Agent, or Firm* — Troutman Pepper Hamilton Sanders LLP

(57) ABSTRACT

A system controls a level crossing of a railway track installation. The railway track installation includes at least one track. The system includes at least two magnetometers associated with the at least one track and placed at corners of a crossing area between the at least one track and a road. The system also includes a level crossing control unit configured for receiving data from the magnetometers. Each magnetometer is arranged to detect a respective magnetic field vector of the earth's magnetic field and to send data representative of the magnetic field vector to the control unit. The control unit is configured to elaborate the data to detect changes in the magnetic field vectors due to the presence of a train in the crossing area and to control the level crossing as a function of the detected changes.

13 Claims, 2 Drawing Sheets

(56) References Cited

U.S. PATENT DOCUMENTS

| | | | | |
|---|---|---|---|---|
| 2014/0339374 | A1* | 11/2014 | Mian | G06T 7/20 246/473.1 |
| 2018/0029619 | A1* | 2/2018 | Rosenberger | G01D 5/268 |
| 2019/0256113 | A1* | 8/2019 | Filippone | B61L 23/042 |
| 2020/0039550 | A1* | 2/2020 | Hounschell | B61L 29/30 |

* cited by examiner

SYSTEM AND METHOD FOR CONTROLLING A LEVEL CROSSING OF A RAILWAY TRACK

FIELD OF TECHNOLOGY

The present invention concerns a system and a method for controlling a level crossing of a railway track.

BACKGROUND

A level crossing is an intersection where a railway line crosses a road or path at the same level, as opposed to railway line crossings using bridges or tunnels. The safety of level crossings is one of the most important issues of railways services. Each year about 400 people in the European Union and over 300 in the United States are killed in level crossing accidents. Collisions can occur with vehicles as well as pedestrians; pedestrian collisions are more likely to result in death.

As far as warning systems for road users are concerned, standard level crossings have either passive protections in the form of different types of warning signs, or active protections, using automatic warning devices such as flashing lights, warning tones and boom gates. Fewer collisions take place at level crossings with active warning systems.

Recently, railroad companies have started to control level crossings through wireless control systems of the trains (e.g. ITCS, ETCS, I-ETMS etc.), because this approach provides many benefits.

In these systems, a signal is wirelessly sent from a control unit of the train towards a control unit associated to the level crossing, thus allowing the latter to properly control the opening or closing of bars or gates placed in correspondence of the level crossing and arranged to prevent the crossing of the level crossing by vehicles or pedestrians present on the intersecting road or path.

This way of controlling the level crossings allows operations to be performed at speeds higher than the traditional activation through track circuits.

Level crossings operated through track circuits activate the crossing based either on initial occupancy of a section of track, or on detection of motion in a section of a track, or on prediction of arrival time based on changes in the electrical impedance of a track measured between the level crossing and the lead axle of the train.

All these track circuit methods have physical limitations as to how far from the crossing they can detect the train.

If a minimum amount of warning time is required for correctly closing the bars of a level crossing, then there is an upper limit to the maximum speed of the train at which track circuits can effectively and timely provide this warning time.

Wireless activation also enables constant warning prediction in areas where it was not previously possible (e.g. electrified rails, areas of poor shunting, etc.).

In some cases, railroad companies have considered to completely eliminate the activation of level crossing through track circuits and to operate them (namely, the bars present in correspondence of level crossings) through wireless activation only.

In fact, track circuits used to operate the bars represent a big expense for companies as they require constant adjustment and maintenance, and numerous train delays occur due to poor operation in harsh environmental conditions or when the track wires are damaged by the track maintenance equipment.

While the wireless level crossing activation potentially enables the elimination of the track circuits, the island track circuit is still required to keep the bars down when a train occupies a short area of a railway track placed on both sides of a road.

In fact, a track circuit controlled level crossing generally has two different track circuits: one approach circuit and one island circuit.

The approach track circuit is a long distance circuit looking for the initial approach of the train, for the purpose of activating the warning devices.

The island track circuit is a short distance circuit that keeps the warning devices activated any time this circuit is occupied by any portion of the train, and is also used to release the activation of the warning devices quickly after the train departs the island area moving away from the crossing.

The main drawback of these existing circuits is that they require both constant adjustment and maintenance and a wired connection to the rails, which is commonly damaged by track maintenance equipment.

As a result, the train movements are restricted until these wired connections are repaired and the level crossing equipment is tested and restored.

There is therefore the need to replace such island track circuits with a solution that is capable of providing a SIL-4 (Safety Integrity Level) train detection, with a reliability equivalent to the one of the solutions based on the island track circuits but that does not require wires or equipment attached to the rails where track maintenance equipment may damage devices of the railway track.

SUMMARY

It is therefore an object of the present invention to provide a system and a method for controlling a level crossing of a railway track which is capable of detecting the presence of a train on the railway track itself without the need of wires attached to the rails, thus enabling safe operation of bars placed in correspondence of the level crossing, by overcoming the limitations of the prior art systems.

This and other objects are fully achieved by a system for controlling a level crossing of a railway track having the characteristics defined in independent claim 1, and by a method for controlling a level crossing of a railway track having the characteristics defined in independent claim 10.

Preferred embodiments of the invention are specified in the dependent claims, whose subject-matter is to be understood as forming an integral part of the present description.

BRIEF DESCRIPTION OF DRAWINGS

Further characteristics and advantages of the present invention will become apparent from the following description, provided merely by way of a non-limiting example, with reference to the enclosed drawings, in which.

DETAILED DESCRIPTION

Figure 1:
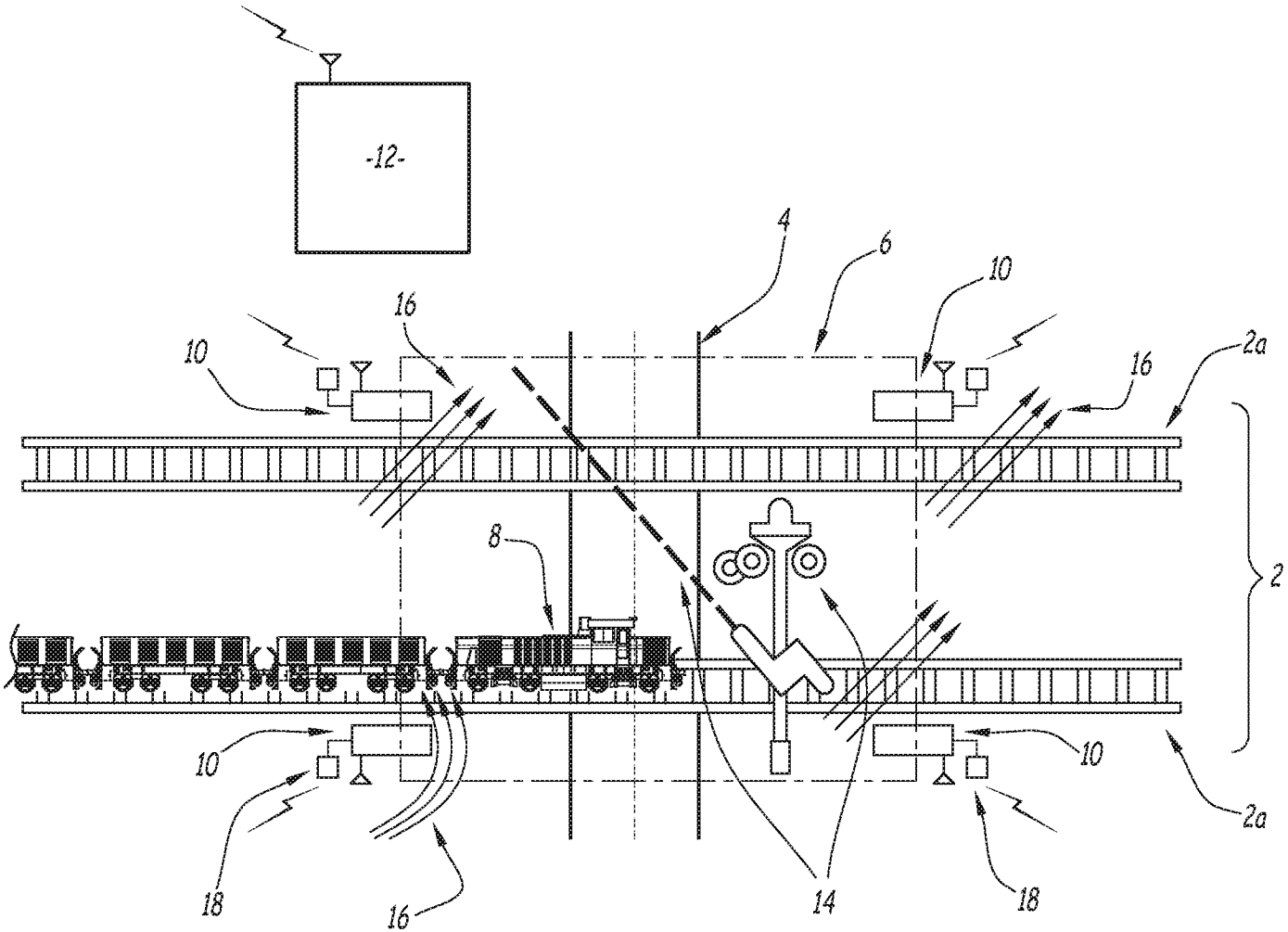
FIG. 1 is a schematic view of a system for controlling a level crossing of a railway track according to the present invention.

FIG. 1 shows a schematic view of a system for controlling a level crossing of a railway track according to the present invention.

A railway track 2 comprising two paths 2*a* crosses a road 4 in a crossing area 6. A train 8 is on one of said two paths 2*a*.

The system of the present invention comprises at least two magnetometers 10 per path 2*a*, placed at the corners of the crossing area 6 where the presence of the train 8 must be detected.

These magnetometers 10 are alternatively placed near the rails of the railway tracks 2*a* of the two paths, buried in the ground, mounted on or in ties, which are known wooden or concrete supports that lie the railway track underneath and that are mounted perpendicular to the rails, etc. The magnetometers 10 can have a wired or wireless connection to a level crossing control unit 12, the so called xWIU (Crossing Wayside Interface Unit), which is arranged to control, preferably in a wireless manner, level crossing warning devices 14 per se known, such as gates, lights, bells, etc. in order to manage all the level crossing activation functions.

Each magnetometer 10 is arranged to detect a respective vector 16 of the earth's magnetic field, along three axes, in particular by measuring amplitude and orientation angle of said vector 16. Data representative of each earth's magnetic field vector 16 are sent by each magnetometer 10 to the control unit 12 through a safety communication protocol per se known, preferably a serial/Ethernet protocol.

When the train 8 occupies the crossing area 6, the earth's magnetic field is reoriented as it is attracted by the large metallic structures of the rail cars of the train 8, such as the engine, the car body, the wheels, etc.

A software algorithm per se known performed by the control unit 12 analyzes the data received by the magnetometers 10 and detects changes in the vectors 16 of the earth's magnetic field, thus determining if the train 8 is present on the railway tracks 2*a*. In particular, a strong shift in the magnetic field vector 16 from a reference is measured when the train 8 passes near the magnetometers 10. As an example, the earth's magnetic field along the Z axis points inward towards the earth's surface at about 500 mG. As the train 8 comes into proximity of the magnetometer 10, it attracts the earth's magnetic field towards the rail cars (i.e. outward from the earth's surface) at a different magnitude and direction, for example about 100 mG. This change, in magnitude and direction along the Z axis, of the earth's magnetic field vector 16 is sensed by the magnetometer 10.

If the earth's magnetic field vector 16 of any one of the magnetometers 10 deviates from a predetermined static magnitude and/or orientation of the earth's natural magnetic field, the crossing area 6 is assumed to be occupied. Conversely, the earth's magnetic field vector 16 of all the magnetometers 10 must be within an expected range to determine the crossing area 6 as unoccupied.

If the crossing area 6 is determined as occupied, the control unit 12 controls accordingly, in a manner known per se, the level crossing warning devices 14, so as to prevent any crossing of the level crossing area 6 by vehicles or pedestrians moving along the road 4.

In addition to the above, in order to protect the system of the present invention against magnetometers' failure modes, for example loss or changes in sensitivity, known calibrated magnetic field sources 18, such as controlled energy sources advantageously including an inductor, are respectively associated to the magnetometers 10 and used to independently verify the sensitivity and accuracy of each magnetometer 10, to ensure the correct operation.

Advantageously, the calibrated magnetic field sources 18 are packaged with the respective magnetometer 10 and positioned with a predetermined orientation.

Through the design of said calibrated magnetic field sources 18 it is possible to control the strength and orientation of a test magnetic field generated by the respective source 18, in particular by controlling the inductance, the current and the mounting direction of these sources 18.

Each source 18 produces a corresponding test magnetic vector.

If a magnetometer 10 does not identify exactly as expected its test magnetic vector, the crossing area 6 is considered as occupied. In fact, the test magnetic vector generated by each source 18 is known a priori because it is generated in a predetermined manner by acting on the source 18 itself, therefore, if the magnetometer 10 associated to each source 18 does not measure the parameters of the test magnetic vector as generated, a failure is determined for the magnetometer 10 and the crossing area 6 is considered as occupied for safety precautions.

These calibrated magnetic field sources 18 are further arranged to be dynamically modified/encoded by changing for example the frequency or phase amplitude, so as to generate different test magnetic vectors to be detected by the associated magnetometer 10, thus verifying that corresponding integrity test data are not impacted by other external magnetic fields. This also allows the integrity tests to be performed periodically, independently of whether or not the train 8 is present in the crossing area 6.

The magnetometer sensitivity and output correctness can be therefore verified each time the test magnetic field is enabled, because each magnetometer 10 is periodically tested using said test magnetic field to ensure that its data are correct and that it is properly functioning.

The data representative of these periodic integrity tests are sent from each magnetometer 10 to the control unit 12 which verifies if the integrity tests have failed, thus assuming that the crossing area 6 is occupied, as above indicated.

All of the features of the system above described provide a failsafe design that is capable of replacing standard island track circuits while avoiding the use of wires attached to the railway tracks 2*a* or additional equipment.

Figure 2:
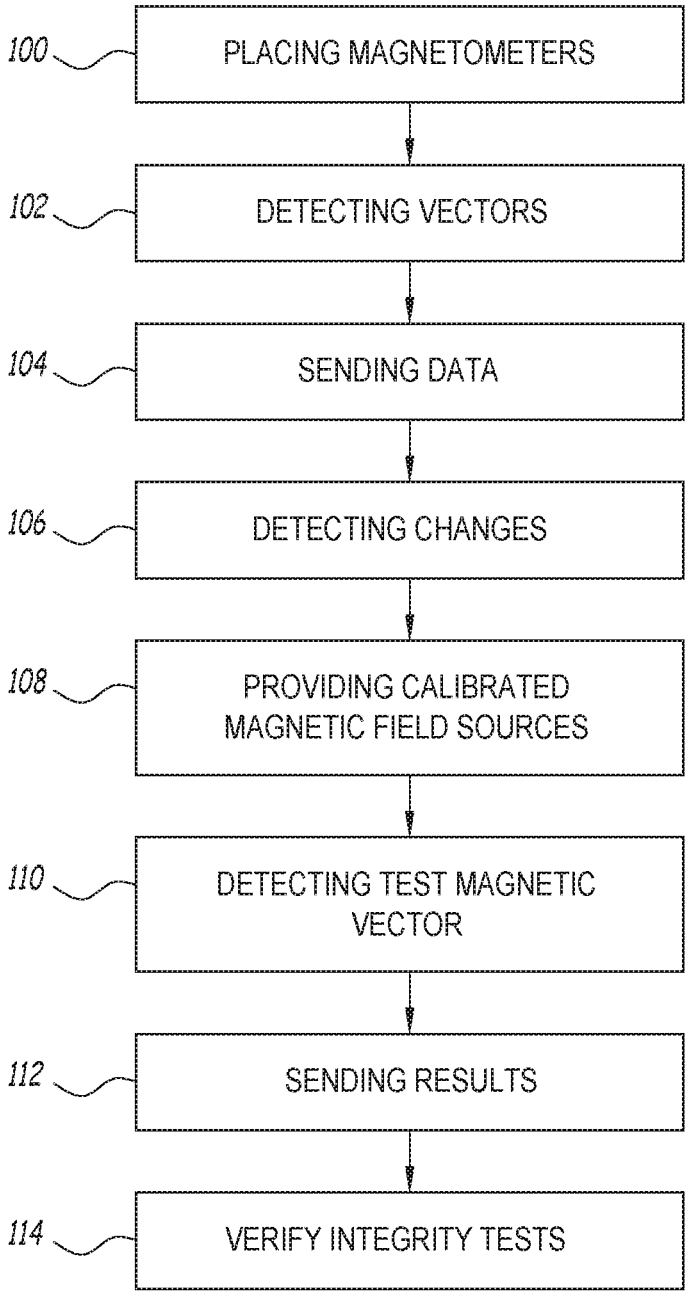
FIG. 2 is a block diagram of the steps of a method for controlling a level crossing of a railway track according to the present invention.

In the following a method for controlling a level crossing island will be disclosed with reference to FIG. 2, which shows a block diagram of the steps to be performed.

The method is performed with reference to a system of the type above disclosed.

In an initial step 100 at least two magnetometers 10 per path 2*a* are placed at the corners of a crossing area 6.

Then, at step 102, each magnetometer 10 detects a vector 16 of the earth's magnetic field along three axes, in particular it detects amplitude and orientation angle of said vector 16.

In a further step 104, data representative of said vectors 16 are sent by the magnetometers 10 to a control unit 12 through a safety communication protocol per se known.

Finally, in a step 106, the control unit 12 detects changes in the vectors 16 of the earth's magnetic field, thus determining that a train 8 is present in the level crossing area 6.

In a preferred embodiment of the invention, the method further comprises the step of providing 108 calibrated magnetic field sources 18 associated to each respective magnetometer 10 and arranged to generate a respective test magnetic vector. The test magnetic vector is detected by the magnetometer 10 to verify the sensitivity of the magnetometer 10 itself and to ensure its correct operation.

In a further step 110 these calibrated magnetic field sources 18 are dynamically modified/encoded so as to generate different test magnetic vectors to be detected by the magnetometers 10, in order to verify that corresponding integrity test data are not impacted by an external magnetic field.

In a final step 112, the data representative of these periodic integrity tests are sent from each magnetometer 10 to the control unit 12 which, in a step 114, verifies if the integrity tests have failed, thus assuming that the crossing area 6 is occupied.

Clearly, the principle of the invention remaining the same, the embodiments and the details of production can be varied considerably from what has been described and illustrated purely by way of non-limiting example, without departing from the scope of protection of the present invention as defined by the attached claims.

The invention claimed is:

1. A system for controlling a level crossing of a railway track installation, the railway track installation comprising at least one track, the system comprising:

at least two magnetometers associated with the at least one track and placed at corners of a crossing area between the at least one track and a road;

a level crossing control unit configured for receiving data from the magnetometers;

wherein each magnetometer is arranged to detect a respective magnetic field vector of the earth's magnetic field and to send data representative of said magnetic field vector to the control unit, the control unit being configured to elaborate said data to detect changes in the magnetic field vectors due to the presence of a train in the crossing area and to control the level crossing as a function of said detected changes.

2. The system of claim 1, wherein the control unit is arranged to control level crossing warning devices associated to the crossing area.

3. The system according to claim 1, wherein said magnetometers are placed near the rails of the at least one railway track or buried in the ground or mounted on or in ties of the at least one railway track.

4. The system of claim 1, wherein said data representative of magnetic field vector are sent by each magnetometer to the control unit through a safety communication protocol.

5. The system of claim 1, wherein the control unit is arranged to detect a strong shift in the magnetic field vector from a reference when the train passes near the magnetometers.

6. The system of claim 1, further including calibrated magnetic field sources associated to a respective magnetometer and configured to verify the sensitivity of each magnetometer to ensure the correct operation of each magnetometer.

7. The system of claim 6, wherein the calibrated magnetic field sources are arranged to generate corresponding test magnetic vectors to be detected by the magnetometers, so as to verify that corresponding integrity test data are not impacted by other external magnetic fields.

8. The system of claim 6, wherein said calibrated magnetic field sources are controlled energy sources including an inductor.

9. The system of claim 6, wherein the calibrated magnetic field sources are packaged with the respective magnetometer and positioned with a predetermined orientation.

10. A method for controlling a level crossing of a railway track installation, the railway track installation comprising at least one track, the method comprising the steps of:

placing the at least two magnetometers of the system according to any of the preceding claims at corners of a crossing area between the at least one track and a road;

detecting, through said magnetometers, respective vectors of the earth's magnetic field;

sending data representative of said vectors to the control unit;

detecting, through the control unit, changes in the magnetic field vectors so as to determine if a train is present in the crossing area, controlling, through the control unit, the level crossing as a function of said changes.

11. The method of claim 10, further comprising providing a calibrated magnetic field source associated to each magnetometer and arranged to generate a respective test magnetic vector to be detected by the associated magnetometer, to be used to verify the sensitivity of the magnetometer to ensure its correct operation.

12. The method of claim 11, further comprising dynamically modifying the calibrated magnetic field source so as to obtain different test magnetic vectors, to be used to verify that corresponding integrity test data are not impacted by an external magnetic field.

13. The method of claim 12, further comprising sending the representative data of the integrity tests performed through the calibrated magnetic field source from the magnetometer to the control unit, which in turn verifies if the integrity tests have failed, thus assuming that the crossing area is occupied.

* * * * *